United States Patent [19]

Becker

[11] Patent Number: 4,874,042

[45] Date of Patent: Oct. 17, 1989

[54] CORRUGATED CARDBOARD HEAT EXCHANGER

[76] Inventor: William Becker, Rte. #1, Princeton, Wis. 57968

[21] Appl. No.: 199,525

[22] Filed: May 27, 1988

[51] Int. Cl.[4] ..... F28F 3/10

[52] U.S. Cl. ..... 165/166; 165/46; 165/54; 165/905; 98/33.1

[58] Field of Search ..... 165/54, 166, 905, 909, 165/76, 46; 98/33.1

[56] References Cited

U.S. PATENT DOCUMENTS

| | | | |
|---|---|---|---|
| 4,308,915 | 1/1982 | Sanders et al. | 165/166 |
| 4,377,400 | 3/1983 | Okamoto et al. | 165/54 |
| 4,384,611 | 5/1983 | Fung | 165/166 |
| 4,411,310 | 10/1983 | Perry et al. | 165/166 |

FOREIGN PATENT DOCUMENTS

| | | | |
|---|---|---|---|
| 2523151 | 4/1976 | Fed. Rep. of Germany | 165/54 |
| 3137296 | 4/1983 | Fed. Rep. of Germany | 165/166 |
| 2381990 | 10/1978 | France | 165/166 |
| 0077883 | 5/1982 | Japan | 165/54 |
| 0205193 | 10/1985 | Japan | 165/166 |
| 0161397 | 7/1986 | Japan | 165/166 |
| 0153394 | 7/1986 | Japan | 165/166 |
| 0153396 | 7/1986 | Japan | 165/166 |

*Primary Examiner*—John Ford

*Attorney, Agent, or Firm*—Foley & Lardner

[57] ABSTRACT

A heat exchange device including a number of panels formed from a flexible frame forming a window and having parallel air paths through the frame, a thin flexible plastic film secured to one side of each frame to form a heat transfer surface across the window, the panels being stacked with each alternate panel turned 90° to form first and second air flow paths through the spaces between the plastic films, the frame being made of corrugated cardboard or fluted plastic.

9 Claims, 2 Drawing Sheets

CORRUGATED CARDBOARD HEAT EXCHANGER

FIELD OF THE INVENTION

The present invention relates to a counterflow heat exchanger and, more particularly, to a heat exchange panel assembly formed by a plurality of corrugated cardboard frames having thin film sheets closing one side of the frame to form the heat transfer surface.

DESCRIPTION OF THE PRIOR ART

New home construction is concerned with efficiency of heating and cooling of the home to reduce costs. Homes are provided with vapor barriers, weather stripping and insulation so that they are effectively air tight. This is effective in preventing fresh air from entering the home and polluted air from escaping from the home. Excess moisture often builds up in the home from showers, cooking and indoor plants. Power vents are provided generally in the kitchen area to exhaust moisture or polluted air from the home but no provision is made for allowing fresh air to enter the home. Excess moisture in the home can damage walls, ceilings and structural frames and create health problems in the home.

There are many sources of harmful gases, odors and irritants in the home such as formaldehyde in the building materials, radon gas, carbon monoxide from fire places, gas furnaces, stoves and water heaters and gas space heaters. The most common method to remove gases from the home is to open windows or doors which reduces the efficiency for both heating and cooling of the home. Heat exchangers are generally available for increasing efficiency of operation of furnaces. Typically these take the form of counterflow heat exchangers utilizing light weight metallic plates. A typical exchange is shown in U.S. Pat. No. 4,308,915 issued on Jan. 5, 1982 entitled "Thin Sheet Heat Exchanger". This type of a heat exchanger is primarily designed for use in the heating system.

In U.S. Pat. No. 4,384,611 issued May 24, 1983 entitled "Heat Exchanger" a folded foil sheet of aluminum, stainless steel or other suitable heat exchange material is wrapped on a frame which is preformed to provide support for the foil.

U.S. Pat. No. 4,411,310 issued Oct. 25, 1983 entitled "Heat Exchange Apparatus Having Thin Film Flexible Sheets" describes a heat exchange apparatus which uses thin film plastic which must be bonded one to another to form a unitized heat exchange structure. Once the sheets have been bonded together, they are held or supported by spacers to maintain the flow path through the sheets.

SUMMARY OF THE INVENTION

The heat exchange device, according to the present invention, is a low cost, highly efficient device that is economical for use by the individual home owner. A principle feature of the invention is the use of a flexible frame having parallel air paths such as corrugated cardboard or fluted plastic sheet. A thin sheet of flexible material secured to one side of the frame to form the heat transfer surface. The panels are stacked to form an air flow path between the flexible material. This construction is simpler than known constructions and provides a highly efficient heat transfer capability.

Another principle feature of the invention is the ability to assemble the panels without the necessity of bonding or sealing the panels.

A further feature of the invention is the ability to replace the panel assembly at a minimum cost and effort.

Other principal features and advantages of the invention will become apparent to those skilled in the art upon review of the following detailed description, claims and drawings.

Figure 1:
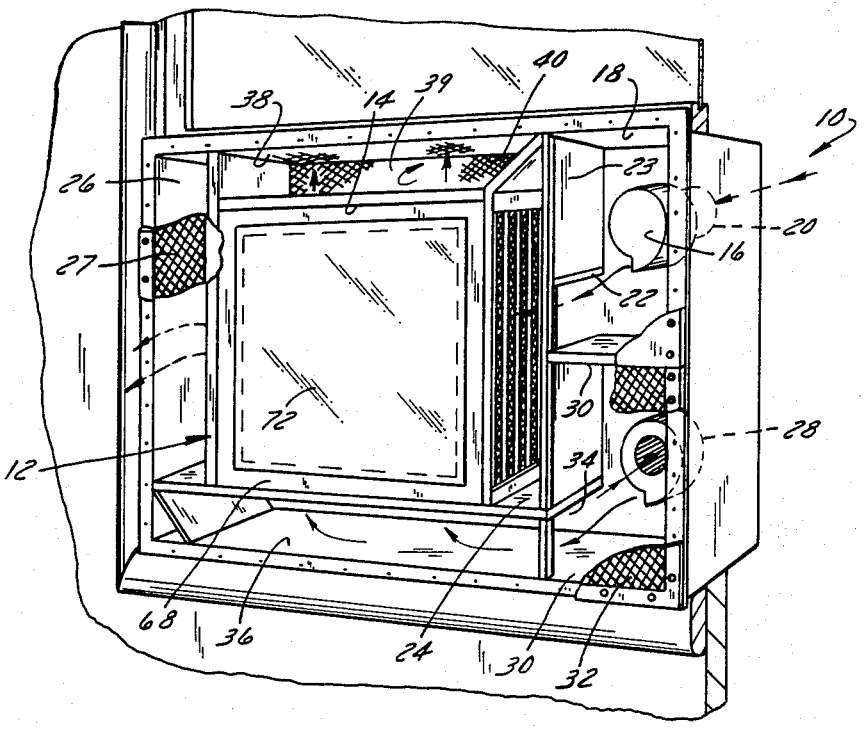
FIG. 1 is a perspective view of one form of the heat exchange device shown with the front cover removed.

Before one embodiment of the invention is explained in detail it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE INVENTION

The heat exchange device according to the invention, as shown in FIG. 1, includes a housing 10 having a heat exchange panel assembly 12 positioned in a compartment 14 in the housing 10. A fresh air blower 16 is positioned within a compartment 18 for drawing air through an inlet 20 and directing the air through an opening 22 in the wall 23 into a chamber 24 on one end of the assembly 12. The air passes through the heat exchange panel assembly 12 in the compartment 14 and is discharged into a chamber 26 for discharge into the room through a screen 27. An exhaust air blower 28 is provided in a compartment 30 in the housing 10 for drawing air through an inlet screen 32 for discharge through an opening 34 into a chamber 36 at the bottom of the panel assembly 12. The air passes through the heat exchange panel assembly 12 and into a chamber 38 at the top of the assembly 12 for discharge through a screen 39 in outlet 40.

Figure 2:
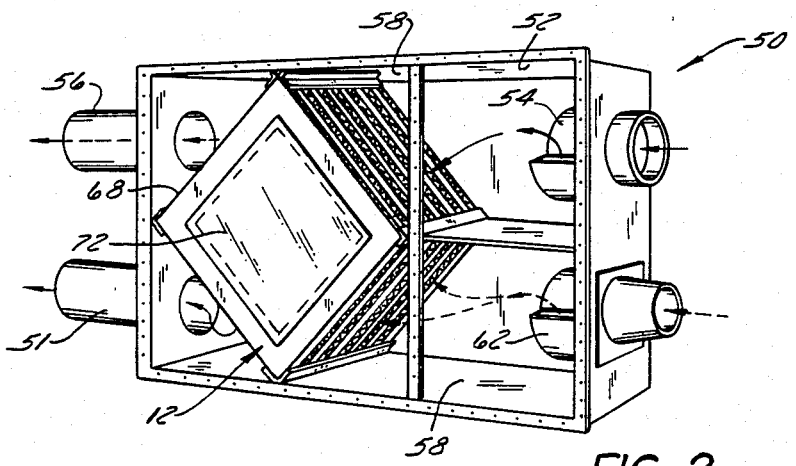
FIG. 2 is a perspective view of an alternative form of heat exchange device shown with the front cover removed.

In the embodiment of the invention as shown in FIG. 2 the housing 50 has a heat exchange panel assembly 12 arranged at an angle in compartment 58 to provide a straight through flow path of air through the ends of the housing. This housing is arranged to provide fresh air to the home furnace return duct 51. The housing includes a compartment 52 having a blower 54 for drawing air into the compartment 58 for passage through the heat exchange panel assembly 12 to the fresh air furnace return duct 51. Exhaust air is drawn into a compartment 58 in the housing 50 by a blower 62 for passage through the assembly 12. The stale air passing through the heat exchange panel assembly 12 to the air exhaust duct 56.

Figure 4:
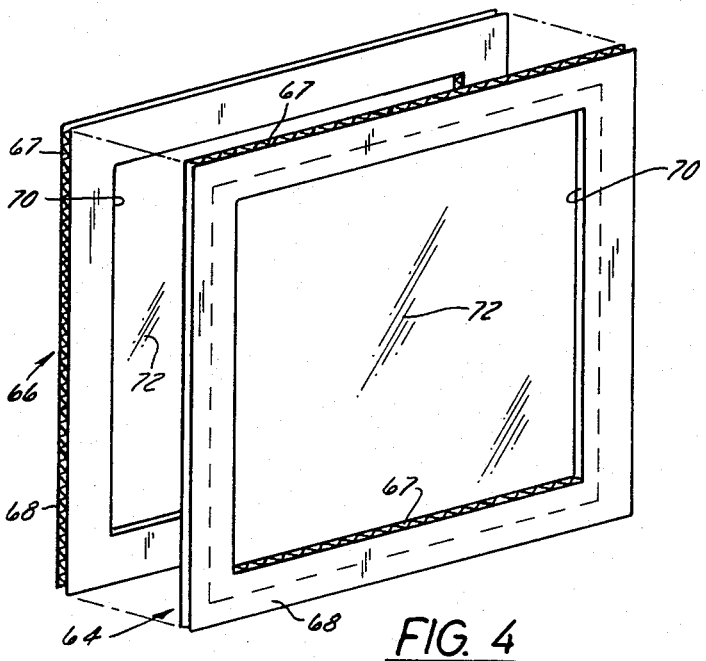
FIG. 4 is a perspective view of two of the heat exchange panels separated to show the air space between the heat transfer film in the adjacent panels.
Figure 5:
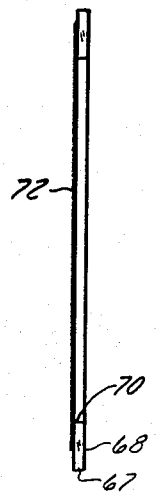
FIG. 5 is a cross-sectional view of one side of the panel.
Figure 6:
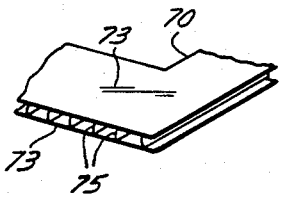
FIG. 6 is a perspective view of a fluted plastic.
Figure 3:
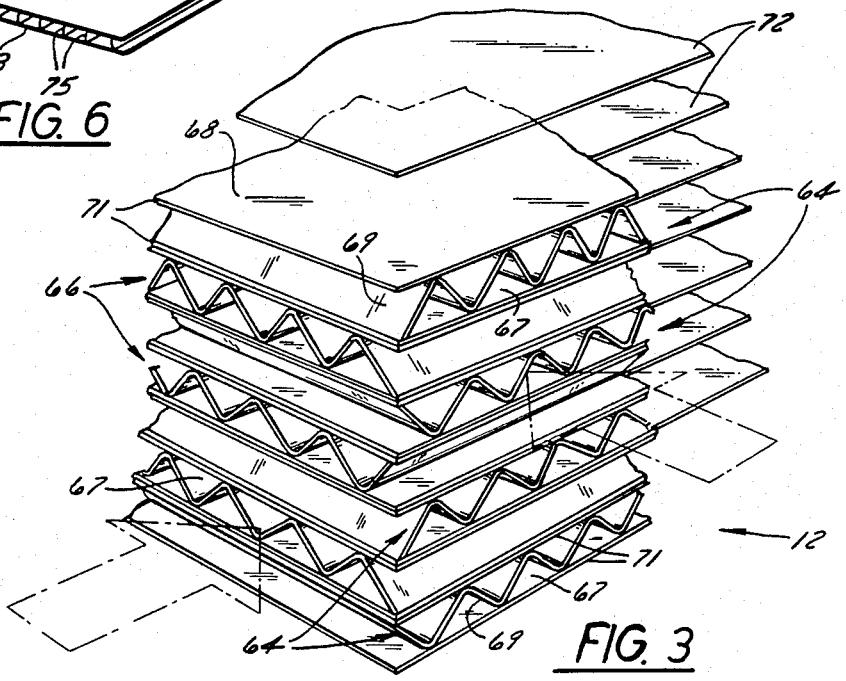
FIG. 3 is a perspective view of a portion of a heat exchange panel assembly showing the alternating arrangement of corrugationed cardboard panels.

In accordance with the invention, the heat exchange panel assembly 12 as seen in FIG. 3 is formed by a plurality of alternately arranged panels 64 and 66. The panels 64 forming a first air path through the assembly and the panels 66 forming a second air path through the panel assembly. Each of the panels 64 and 66, as seen in FIGS. 4 and 5, is formed from a flexible frame 68 which includes a plurality of parallel flow paths 67 through the frame. The frame can be made of a corrugated strip 69 having a paper sheet 71 on each side of the corrugated strip or a flexible plastic material having a pair of thin plastic sheets 73 separated by dividers 75 which form flutes through the panels. The frame 68 forms a window 70. A clear plastic film 72 is secured to one side of the frame 68 to cover the window and form a heat transfer surface. The film is preferably made of a polyethylene material having a thickness of 0.0005 to 0.0025 inches. A heat shrinkable plastic material can be used to provide a tight film across the frame. The window 70 is enclosed on the opposite side by means of the film 72 on the next panel 66. The panels 64 are turned 90° with respect to the next panel 66 so that the corrugations in the panels 64 are perpendicular to the direction of the flutes in the panel 66. The plastic film although normally having a low thermal conductivity, is so thin that heat is easily transferred through the film to the cold air passing through the adjacent panels.

The panels 64 and 66 are assembled by merely stacking one panel on top of the other. A seal is formed between the frames 68 by applying a slight pressure to the outside surfaces of the end panels. The corrugated cardboard and fluted plastic material have sufficient flexibility to automatically form a seal with the adjacent panels. The window in the last panel in the stack is closed by providing a film 72 on both sides of the last frame.

It is also within the contemplation of this invention to form the frames 68 with a single corrugated strip 69 having a window which is enclosed by a single sheet 71 of paper secured to one side of the corrugated strip.

Thus, it is apparent that there has been provided in accordance with the invention, a corrugated cardboard heat exchanger that fully satisfies the aims and advantages set forth above. While the invention has been described in conjunction with specific embodiments thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. A heat exchange device comprising a housing having an inlet and an outlet for a first fluid and an inlet and an outlet for a second fluid, a heat exchange panel assembly mounted in said housing in fluid communication with said first fluid inlet and outlet and said second fluid inlet and outlet, said assembly including two sets of panels alternately arranged to form a separate flow path for said first fluid inlet and outlet and said second fluid inlet and outlet, each of said panels including a frame formed from a fluted plastic material having two spaced sheets connected by flutes defining a plurality of parallel air paths and a sheet of plastic material enclosing one side of said frame to form a heat transfer surface, said panels being alternately arranged at 90° with respect to the adjacent panels;

whereby the air paths in one set of panels form a flow path through the housing for said first fluid and the air paths in said second set of panels form a flow path for said second fluid.

2. The heat exchange device according to claim 1 wherein said plastic material comprises a heat shrinkable film.

3. The heat exchange device according to claim 1 or 2 wherein the last frame in said assembly includes a sheet of plastic material on the both sides of the frame.

4. A heat exchange core comprising a plurality of frames formed from a fluted plastic material having two spaced sheets connected by flutes and wherein said fluted plastic material forms a plurality of generally parallel flow paths through said frames, a plastic film secured to one side of each of said frames to form a heat transfer surface on said one side of each of said frames, said frames being stacked so that each alternate frame is turned 90° with respect to each adjacent frame, said plastic film on each frame engaging the other side of the adjacent frame to enclose the air spaces in each frame, whereby said air space in each alternate frame forms a first flow path between said parallel flow paths in one direction through said core and the air space in the alternate frames forms a second air path between said parallel flow paths in the other direction through said core.

5. The claim according to claim 4 wherein said plastic film comprises a heat shrinkable material.

6. A heat exchange device comprising a housing having an inlet and an outlet for a first fluid and an inlet and an outlet for a second fluid, a heat exchange panel assembly mounted in said housing in fluid communication with said first fluid inlet and outlet and with said second fluid inlet and outlet, said assembly including two sets of panels alternately arranged to form a separate flow path for said first fluid inlet and outlet and for said second fluid inlet and outlet, each of said panels including a corrugated cardboard frame having a plurality of parallel air paths and a sheet of plastic material enclosing one side of said frame to form a heat transfer surface, said panels being alternately arranged at 90° with respect to the adjacent panels, whereby the air paths in one set of panels form a flow path through the housing for said first fluid and the air paths in said second set of panels form a flow path for said second fluid.

7. The device according to claim 6 wherein said plastic material is a heat shrinkable material.

8. A heat exchange core comprising a plurality of frames formed from a corrugated cardboard material having a plurality of flow paths, a plastic film secured to one side of said frame to form a heat transfer surface on one side of said frame, said frames being stacked so that each alternate frame is turned 90° with respect to each adjacent frame, whereby the air paths of each alternate frame form a first flow path in one direction through said core and the air paths in the alternate frames form a second air path in the other direction through said core.

9. The device according to claim 8 wherein said plastic film comprises a heat shrinkable material.

* * * * *